United States Patent [19]

Schultheiss et al.

[11] 3,997,929

[45] Dec. 21, 1976

[54] CARRIER SLEEVE

[75] Inventors: Wolfram Schultheiss, Kiefernweg; Harald Hoffmann, Mannheim, both of Germany

[73] Assignee: Firma Carl Freudenberg, Weinheim an der Bergstrasse, Germany

[22] Filed: Aug. 15, 1975

[21] Appl. No.: 605,576

Related U.S. Application Data

[63] Continuation of Ser. No. 398,631, Sept. 19, 1973, abandoned.

[30] Foreign Application Priority Data

Sept. 29, 1972 Germany ..... 2247751

[52] U.S. Cl. ..... 8/155.1; 68/198

[51] Int. Cl.[2] ..... D06B 23/04

[58] Field of Search ..... 8/155.1, 155.2; 68/198; 242/118.1, 118.11, 118.2, 118, 159; 15/244 R

[56] References Cited

UNITED STATES PATENTS

| | | | |
|---|---|---|---|
| 712,986 | 11/1902 | Wardwell | 242/159 X |
| 3,015,945 | 1/1962 | Jungbecker | 68/198 |
| 3,106,725 | 10/1963 | Stiner et al. | 8/155.1 |
| 3,522,700 | 8/1970 | Fisher | 242/118.2 X |

*Primary Examiner*—Philip R. Coe
*Attorney, Agent, or Firm*—Burgess, Dinklage & Sprung

[57] ABSTRACT

In a method of dyeing or bleaching shrinking yarns positioned in the form of cheeses or cross/wound packages on a fiber package by contacting said yarns with a dyeing or bleaching liquor while the same are maintained on said fiber package, the improvement which comprises utilizing as the packaged one having an interior sleeve of a porous, elastic, non-woven fabric of synthetic fibers, said fabric free of any binding agent, said synthetic fibers being largely non-dyeable under the conditions of the dyeing process.

25 Claims, 3 Drawing Figures

CARRIER SLEEVE

This is a continuation, of application Ser. No. 398,631 filed Sept. 19, 1973, and now abandoned.

BACKGROUND OF THE INVENTION; FIELD OF THE INVENTION

This invention relates to a carrier sleeve for a yarn package, especially carrier sleeve for cheeses and crosswound packages employed to carry shrinking yarn during a bleaching and dyeing process. More particularly, the present invention relates to a process of dyeing or bleaching shrinking yarns while the same are maintained on the fiber package utilizing as the fiber package one which has an interior sleeve made of a porous, elastic, non-woven fabric which fabric is free of binding agent, the synthetic fibers of the fabric being largely non-dyeable under the conditions of the dyeing process.

DISCUSSION OF THE PRIOR ART

It is known to bleach and dye shrinking yarns in hank form. In the hank form, the yarn can shrink unimpededly during the dyeing or bleaching process, so that it will not be deformed. In this manner the desired soft feel and volumenous appearance of the yarn is maintained. However, the operations involved in hank dyeing, to wit, the twice reeling of the hanks are disadvantageous in that a great expenditure of time is involved in preparing the hanks. This is expensive with respect to labor costs and the dyeing apparatus is badly used under certain dyeing liquor ratios.

From an economical point of view cheese dyeing offers an important advantage. If, in this process, a yarn package is prepared, for example from non-preshrunk yarn then treated in a dyeing or bleaching liquor, the yarn becomes compressed and is deformed primarily at the innermost layers by the shrinking that occurs during the dyeing and bleaching process. (The winding density, type of winding and shape of the yarn package influence the evenness of dyeing, the feel of the dyed yarn and the utilization of the dyeing apparatus. The greater the winding density is, the better will be the utilization of the dyeing apparatus).

Unevenness in this way of cheese dyeing is caused by the fact that the package becomes hard. Uniform penetration of the dye liquor into the wound yarn on the package is no longer assured. As a result, the yarn feels stiff and is flat as it comes off the cheese. Differences in the reflection of light from the so-deformed yarn results in optical unevenness.

As a result of the above-described disadvantages, the yarn is preshrunk prior to bleaching or dyeing in cheese form. This preshrinking is performed discontinuously by steaming. Oftentimes repeated steaming and rewinding are necessary especially with certain yarns.

Next to the dyeing process employing a cheese, dyeing and bleaching in the form of cross-wound packages (soft packages) has proven effective. In this case, a yarn package is also prepared from yarn that has been prebulked in a continuous bulking machine. It is then treated in a dyeing or bleaching bath, as the case may be, and afterward treated in the desired manner. The stability of the cross-wound packages is substantially poorer than that of the cheeses. This produces the danger of package deformation in the dyeing or bleaching resulting in difficulties in rewinding the yarn. To prevent slippage of the inner and outer yarn layers, the yarn package has to be wrapped in a so-called stockinette. The wrapping and removal of the stockinette can be performed only manually, thus necessitating the expenditure of time and money for labor. Another disadvantage resides in that, when the stockinette is used, tangling of the innermost yarn layers occurs in spite of it, resulting in increased yarn wastage.

In order to improve the dyeing and bleaching processes employing cheeses and cross-wound packages, attempts have been made to use dyeing sleeves made of foamed resilient plastic material. These sleeves, however, have not been successful because they have poor resistence to chemicals, especially bleaches, employed in the dyeing and/or bleaching process. They tend to decompose and contaminate the bath and the yarn package. The plastic foam is, furthermore, greatly colored and, for this reason, cannot be reused.

SUMMARY OF THE INVENTION

The disadvantages of the dyeing and/or bleaching of shrinking yarns on cheeses or cross-wound packages is almost eliminated, in accordance with the present invention which resides in a method of dyeing or bleaching yarns positioned on a fiber package by contacting said Yarns with a dyeing or bleaching liquor while the same are maintained on said fiber package. The present invention is an improvement in such dyeing or bleaching which improvement comprises utilizing as the package one having an interior sleeve of a porous, elastic, non-woven fabric of synthetic fibers, said fabric free of binding agent, said synthetic fibers being largely non-dyeable under the conditions of the dyeing or bleaching process.

In accordance with this invention there is provided a carrier sleeve for a yarn package such as a carrier sleeve for a cheese or a cross-wound package which carrier sleeve is made of a particular material-one composed of synthetic fibers which are largely non-dyeable under the conditions of dyeing or bleaching. The synthetic fibers employed in the carrier sleeve are employed in the form of a non-woven fabric which fabric is both porous and elastic. Preferably the fibers of the fabric are consolidated so as to form a coherent mass. Methods of consolidation include for instance needling and/or heating. It is also preferred that the side facing the yarn to be dyed or bleached is smoothed. The smoothing can be accomplished by the use of heat with or without added pressure. It is preferred that the fibers of the non-woven fabric be crimped fibers. These fibers can be both synthetic staple fibers or they can be synthetic continuous fibers.

The non-woven fabric employed as the package sleeve in accordance with the present invention has a thickness between 2 and 20 mm. preferably between 4 and 10 mm. As indicated above the non-woven fabric is porous. Generally, it should have a void volume between 53 and 99% preferably between 80and 94%. Therefore the fabric of the present invention will have a weight between 100 and 3000 gms. per $m^2$ of fabric. Preferably this value is between 400 and 1200 gms. per $m^2$ of fabric.

As indicated above the non-woven fabric can be made of staple or continuous filament synthetic fibers. The fibers can be polyamide fibers especially nylon 6, nylon 6/6, polyolefin fibers, polyester fibers, especially polyester of a terephthalic acid moiety and an aliphatic or aromatic diol and polyacrylic fibers. Preferably the fibers are polyolefin fibers especially polypropylene fibers.

The nature of the fibers of the non-woven fabric are related to the conditions of the dyeing and bleaching process which, in turn, of course, are related to the nature of the yarn on the package. The fibers of the non-woven fabric shall possibly not be susceptible to dyeing of the yarn of the package during the dyeing process. For instance if polyacrylic high bulk yarns are dyed the non-woven fabric should not consist of acrylic fibres but better of polypropylene fibers.

Figure 1:
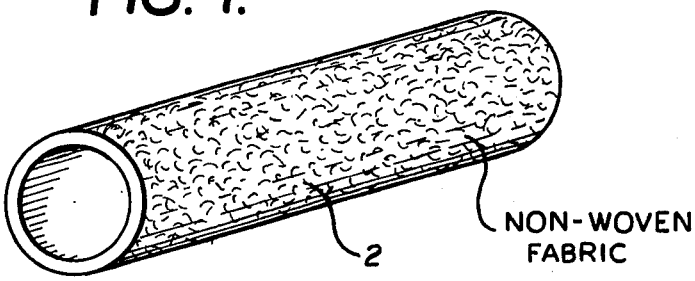
FIG. 1 is a perspective view showing a carrier sleeve of the invention.

The sleeve of the yarn package in addition to being porous must have a degree of elasticity. Generally speaking, the sleeve will have an elasticity between 30 and 90%, preferably between 55 and 85%. Such indicates the extent to which the fabric can expand and/or contract under conditions of force and the percentage is referred to the original dimensions of the non-woven fabric sleeve of the package.

DESCRIPTION OF PREFERRED EMBODIMENTS

By the use of the carrier sleeve in accordance with the invention the known disadvantages of the otherwise advantageous method of dyeing and bleaching cheeses and cross-wound packages are almost entirely eliminated. The pressure action caused by the shrinkage or the residual shrinkage of the yarn package can be slowed down by the elasticity of the sleeve material, and the deformation of the yarn, especially of the innermost layers, is prevented or substantially reduced. In this manner greater security is obtained with regard to the evenness of the yarn. The danger of the yarn flattening on the dye sleeve or on the dye tube of the material carrier is substantially diminished. The cheese or cross-wound package is enabled to equalize any unequal winding densities. In the dyeing of certain yarns, the formerly necessary repeated steaming and rewinding can be eliminated, since the carrier sleeve is in a position to slow down the pressure action caused by the full shrinkage of the yarn and hence of the yarn package which occurs in the dyeing process. Due to the diminished pressure action caused by the residual shrinkage, substantially greater amounts of material can be wound and processed per spool in the case of some yarns, because the above-mentioned deformation of the innermost yarn layers no longer occurs.

The carrier sleeve of the invention consists preferably of a non-woven fabric made of elastic, preferably crimped staple or endless fibers. It is desirable that it consists of polyolefin fibers which are chemically resistant. This also assures the greatest possible non-dyeability by the dyes in the dyeing liquor. Polyolefin fibers are furthermore stable at the dyeing temperatures used and can be reused repeatedly. Resistance to the flow of the dye liquor through the carrier is less than the resistance of the yarn package being dyed. The smoothed surface of the carrier sleeve facing the yarn enables the dyed yarn to be unwound without problems.

The carrier sleeve made of a porous elastic non-woven fabric can be of tapered or cylindrical construction and is made from a piece cut to pattern, by stitching, heat sealing or cementing, it being important to prevent the properties of the non-woven material from being affected by the seam. A thread used for stitching should therefore consist of the same material as the fibers used in making the non-woven material. For example, a polypropylene non-woven should be stitched with a polypropylene thread. If heat sealing or cementing of the seam should be preferred, the same should have the same porosity and elasticity as the non-woven material.

The manufacture of the non-woven fabric for the carrier sleeve of the invention is best performed by means of suitable combing machines of the prior art. A fiber mat is combed from difficult-to-dye, crimped synthetic fibers. It has been found that polyolefin fibers and especially polypropylene fibers are most suitable. Both fine fibers as well as the coarsest fibers on the market or mixtures of different finenesses may be used.

Optimum qualities are obtained in the carrier sleeves when crimped polypropylene fibers with a high recovery and medium tensile strength are used, in a mixture of approximately 70% fibers with a fiber of 70 dtex and a cut length of about 90 mm., and about 30% fibers with a fiber of 17 dtex and a cut length of about 60 mm.

The combed mat is consolidated by needling in a known manner without the use of a binding agent. At a fabric weight of about 800 g/m$^2$ it is desirable that the material thickness be about 6 mm. It has been found that a material of this kind is generally well suited for the present application. Lower and higher weights and densities are also possible, however, and come within the scope of this patent application.

After consolidation of the mat by needling it is desirable to remove any shrinkage of the material by a suitable heat treatment, say, in a flat-band dryer, and thus to fix the mat to be used in making the carrier sleeves.

To prevent fibers from coming loose from the needled non-woven fabric during the dyeing process, the fiber bond may be additionally strengthened at the surface on one or both sides by appropriate measures. This strengthening is performed in a prior-art manner by the use of heat, and in some cases pressure, to produce a fusing of the fibers at the surface. The porosity of the fabric must not be appreciably impaired by the fusion of the fibers. After the fusing of the fibers at the surface the surface of the fabric may be smoothed by means of cooled rolls.

Figure 2:
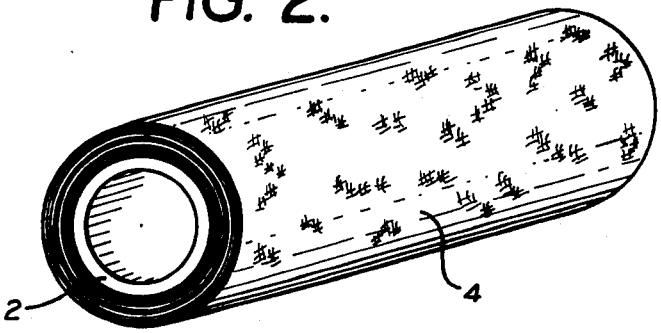
FIG. 2 is a perspective view showing the carrier sleeve of FIG. 1 carrying yarn wrapped thereabout to be dyed or bleached.
Figure 3:
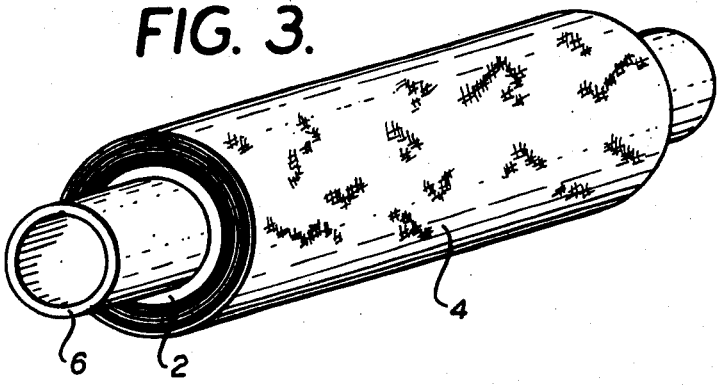
FIG. 3 is a perspective view similar to FIGS. 1 and 2 showing the carrier sleeve disposed about a conventional package dyeing machine spindle.

Referring to the drawings there is shown a cylindrical member 2 made of a non-woven fabric which acts as a carrier sleeve. When yarn is wrapped about carrier sleeve 2 the carrier sleeve 2 becomes interior of the yarn or acts as an interior sleeve thereof. In FIG. 2 the yarn is shown at 4. The dyeing or bleaching can take place simply by immersing the carrier sleeve 2 containing the yarn 4 wrapped thereabout into a dye or bleach bath. Alternatively, the ends of the carrier sleeve can have inserted therein a conventional package dyeing machine spindle 6.

We claim:

1. In a method of dyeing or bleaching shrinking yarns positioned in the form of cheeses or cross-wound packages on a fiber package having a carrier sleeve by contacting said yarns with a dyeing or bleaching liquor while the same are maintained on said fiber package, the improvement which comprises utilizing as the package one whose carrier sleeve is of a thickness of at least 2 mm and is made of a porous elastic non-woven fabric of synthetic fibers, said fibers selected from the group consisting of polyamides, polyolefins, polyesters and polyacrylics, said fabric free of any binding agent, said synthetic fibers being largely non-dyeable under the conditions of the dyeing or bleaching process.

2. A process according to claim 1, wherein said non-woven fabric has been subjected to unilateral consolidation and has been rendered smooth on the side facing the yarn to be dyed.

3. A process according to claim 2, wherein the fibers of the non-woven fabric have been consolidated by needling.

4. A process according to claim 2, wherein the fibers of the non-woven fabric have been consolidated by heating the non-woven fabric.

5. A process according to claim 1, wherein the non-woven fabric has a porous and elastic seam.

6. A process according to claim 1, wherein the fiber of the non-woven fabric is crimped, staple fiber.

7. A process according to claim 1, wherein the fiber of the non-woven fabric is crimped continuous fiber.

8. A process according to claim 1, wherein the fiber of the non-woven fabric is polyolefin fiber.

9. A process according to claim 1 wherein said package has a thickness between 2 and 20 mm.

10. A process according to claim 9 wherein said fabric has a thickness between 4 and 10 mm.

11. A process according to claim 9 wherein said fabric has a void volume between 53 and 99%.

12. A process according to claim 9 wherein said fabric has a void volume between 80 and 94%.

13. A process according to claim 9 wherein said fabric has a weight between 10 and 3,000 grams per square meter.

14. A process according to claim 13 wherein said fabric has an elasticity between 30 and 90%.

15. A process according to claim 14 wherein said fabric has an elasticity between 55 and 85%.

16. A method according to claim 1 wherein said synthetic fibers are polypropylene fibers.

17. A cheese or crosswound package having disposed thereon a dyeable or bleachable yarn, said package constituting a carrier sleeve of a porous elastic non-woven fabric of synthetic fibers, said synthetic fibers being selected from the group consisting of polyamides, polyolefins, polyesters, and polyacrylics and being largely non-dyeable, said fabric free of any binding agent, said fabric having a thickness of at least 2 mm.

18. A package according to claim 17 wherein said fabric has a thickness between 4 and 10 mm.

19. A package according to claim 17 wherein said fabric has a void volume between 53 and 99%.

20. A package according to claim 19 wherein said fabric has a void volume between 80 and 94%.

21. A package according to claim 19 wherein said fabric has a weight between 10 and 3,000 gms./sq. meter.

22. A package according to claim 21 wherein said fabric has a weight between 400 and 1200 gms/sq. meter.

23. A package according to claim 21 wherein said fabric has an elasticity between 30 and 90%.

24. A package according to claim 23 wherein said fabric has an elasticity between 55 and 85%.

25. A package according to claim 17 wherein said synthetic fibers are polypropylene fibers.

* * * * *